US006325531B1

(12) United States Patent
Lindley

(10) Patent No.: US 6,325,531 B1
(45) Date of Patent: Dec. 4, 2001

(54) CONCRETE VIBRATOR HEAD WITH ENHANCED VIBRATION AND FLUID BEARING

(76) Inventor: Thomas R. Lindley, 7845 Wice Church Rd., Boaz, KY (US) 42027

( * ) Notice: Subject to any disclaimer, the term of this patent is extended or adjusted under 35 U.S.C. 154(b) by 0 days.

(21) Appl. No.: 09/453,778

(22) Filed: Dec. 3, 1999

(51) Int. Cl.[7] ..... B01F 11/00
(52) U.S. Cl. ..... 366/121; 366/123
(58) Field of Search ..... 366/117, 120–123, 366/128, 331

(56) References Cited

U.S. PATENT DOCUMENTS

| | | | | |
|---|---|---|---|---|
| 2,073,393 | | 3/1937 | Mall . | |
| 2,148,765 | | 2/1939 | Mall . | |
| 2,215,888 | * | 9/1940 | Swarthout | 366/121 |
| 2,269,938 | | 1/1942 | Jackson . | |
| 2,278,839 | | 4/1942 | Douglass . | |
| 2,400,321 | | 5/1946 | Troxell . | |
| 2,454,620 | | 11/1948 | Wilde . | |
| 2,479,799 | | 8/1949 | Wilde . | |
| 2,492,431 | | 12/1949 | Kroeckel . | |
| 2,597,505 | * | 5/1952 | Lindkvist | 366/121 |
| 2,651,980 | | 9/1953 | Wells et al. . | |
| 2,771,279 | | 11/1956 | Dearden . | |
| 3,042,386 | | 7/1962 | Wyzenbeek . | |
| 3,180,625 | | 4/1965 | Wyzenbeek . | |
| 3,188,054 | | 6/1965 | Mason, Jr. . | |
| 3,260,509 | | 7/1966 | Rudy et al. . | |
| 5,556,199 | | 9/1996 | Oswald . | |
| 6,155,708 | * | 12/2000 | Lindley | 366/123 |

FOREIGN PATENT DOCUMENTS

730947 * 4/1980 (SU) ..... 366/121

OTHER PUBLICATIONS

Lievers, "Electric Hand–Held–Poker–Vibrator Type P14," Poker Vibrators, Jul., 1984.

* cited by examiner

*Primary Examiner*—Charles E. Cooley
(74) *Attorney, Agent, or Firm*—King and Schickli, PLLC

(57) ABSTRACT

An improved head for use with a concrete vibrator for settling concrete/aggregate is provided. The head includes a hollow casing with an eccentric rotor having a curved segment along one side and supported for rotation by a bearing at a first or drive end. A second bearing is provided adjacent a second, distal end of the rotor. In one embodiment, the second bearing includes a bushing of disparate material, such as brass. A lubricant in the casing forms a thin, high pressure oil film between the bushing and the internal surface of the distal end cap, as well as between the curved segment of the rotor and the internal surface of the casing. Since the eccentricity of the rotor is extended, enhanced vibration is obtained. In this first embodiment, the bushing is brazed to the distal end of the rotor and the casing is steel. The bushing is arcuate and is positioned in close proximity to the internal surface of the distal end cap along the curved segment and at its axial edge. A leading bevel edge on the bushing, as well as the rotor, assists in capturing the lubricant to form the thin film as the rotor rotates. In a second embodiment, single rotary bearings support the ends in conjunction with the hydraulic bearing formed between the rotor and the internal surface of the casing.

7 Claims, 2 Drawing Sheets

A
10
12
15
16
16a
17
18
20
21
21a
25
35
40
41
42
45
F
3
3

10
15
16
16a
18
20
21
25
50
51
52
12
A
5

CONCRETE VIBRATOR HEAD WITH ENHANCED VIBRATION AND FLUID BEARING

TECHNICAL FIELD

The present invention relates generally to building of structures of concrete, and more particularly, to an improved vibrator head adapted for use with a lightweight, portable concrete vibrator.

BACKGROUND OF THE INVENTION

It is a well known principle that the integrity of concrete structures is improved by making sure that the wet concrete poured into the form is substantially homogeneous; that is with the aggregate spread and evenly distributed and substantially all voids or air pockets eliminated. To do this, it is common practice to insert a vibrating head into the wet concrete within the retaining form. As the head is moved up and down and around the form and between the grid of reinforcing bars, pockets of aggregate or voids are eliminated. In my so-pending U.S. patent application Ser. No. 09/233,801, Jan. 19, 1999 and entitled "Concrete Vibrator", now U.S. Pat. No. 6,155,708, issued Dec. 5, 2000, I disclose and claim an improved vibrator that includes such a head and driven by a light-weight gasoline motor connected through a flexible drive cable within a sheath. The vibrator of that patent application represents a substantial improvement over prior art devices in assuring the proper spreading of the aggregate and elimination of the voids in the wet concrete. As disclosed, this desired result is accomplished by providing an intense, reasonably high frequency and amplitude vibration to the concrete from the vibrator head, This prior application is incorporated in the present application by reference.

As set forth in the '801 application, a variety of rotor shapes are disclosed in the prior art. Typically, such as shown in the Lyle U.S. Pat. No. 4,057,222, the rotor is a standard metal bar with approximately one-half removed along the longitudinal axis. The rotor has stub shafts at each end for mounting in a metal casing by dual roller bearings mounted at both ends. A similar arrangement is illustrated in the U.S. Pat. No. 3,042,386 to Wyzenbeek. While this type of mounting has proven successful, additional improvement in the rotor and its mounting is possible. It is particularly desirable to provide enhanced vibration for a particular rotor mass, and without an increase in speed from my previous design, while at the same time assuring that the rotary mounting of the rotor is stable and secure. Improvements in durability, long life and low maintenance cost are also desirable.

Improving the efficiency of the vibration to provide better aggregate spreading and filling of the voids and air pockets has been attacked from many directions in the past. This fact is attested by the concepts shown in the patents described as background in my prior '801 application, and many others. Increasing the intensity of vibration in a concrete vibrator of the type disclosed in the '801 application to accomplish the improved results while maintaining the reduced speed of rotation is important. If successful, such a design change would further enhance the ease and efficiency of use of the concrete vibrator by the worker, thus providing still further increases in productivity and reduction of fatigue during use. At the same time, it is desirable to simplify the eccentric rotor to further reduce the initial cost and to ensure that the maintenance requirements are minimized and the expectant life of the head is extended. Also, a guide line must be that any new vibrator head is adapted for use in the concrete vibrator unit of the '801 application.

SUMMARY OF THE INVENTION

With the above needs for improvement of the vibrator head in mind, it is a primary object of the present invention to provide a head that is more effective in spreading and distributing the aggregate and wet concrete in a form to thereby enhance the integrity of the concrete structure, and in doing so to overcome the above described limitations and disadvantages of the prior art in a unique and very desirable way.

It is another object of the present invention to provide a concrete vibrator head that provides extended eccentricity of the rotor to substantially its full length so as to produce the enhanced vibration of the rotor mass.

It is still another object of the present invention to provide a vibrator head that is not only low in cost, but also simplifies the structure reducing the potential maintenance over the life of the head.

Another object of the invention is to provide support for the rotor during its circular path of movement by a fluid bearing.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, there is provided an improved vibrator head for a concrete vibrator of the type for evenly distributing the aggregate and filling voids in wet concrete poured in a form for concrete structures. The vibrator head is made more effective for enhanced vibration, has a fluid bearing and is further simplified from the head disclosed and claimed in my so-pending '801 application and all other prior art designs.

The vibrator head of the first embodiment of the present invention includes a hollow casing and a substantially full length eccentric rotor mounted therein. The rotor is supported at a first or proximate end by conventional bearing means, such as a pair of roller bearings. A drive shaft imparts rotary motion to the rotor and is designed to be driven through a flexible shaft.

The rotor includes a curved segment along one of its sides that extends in an arc of approximately 120°. The centroid of the mass of the rotor is such as to provide a highly effective vibratory action as the rotor is rotated. It is desirable that the rotor strength is maintained to resist lateral flexing within the casing.

The rotor is machined from cold rolled steel that provides the desired mass along with reasonably good machining properties. Alternative approaches, such as casting the metal or other relatively high density material to form the rotor are considered to be equivalent. The rotor includes a pintle or stub shaft at the first end of the rotor for mounting the dual roller bearings. The manner in which the high strength of the rotor is obtained, is set forth and claimed in my prior U.S. '801 patent application.

According to one feature of this first embodiment of the present invention, the stub shaft and the dual roller bearings at the second or distal end (non-drive end) are eliminated. Instead, a simple bushing is attached to the curved segment. The bushing is fabricated of disparate material, that is, a material of different molecular structure than the casing so that there is minimal affinity for wear.

A lubricant, preferably 10 W or 20 W motor oil, or equivalent, such as other high quality hydraulic fluid with similar lubricating and viscosity rating, is in the casing. It forms a thin, high pressure film between the support bushing and the internal surface of the casing. The high pressure, at about 70–80 lbs/in$^2$, is generated by the rotation of the rotor and the squeezing of the oil between bushing and the casing due to the centrifugal force. The spacing of approximately 1/64 inch works well. At 5,000–7,000 rpm, the rotor in this embodiment balances itself on the hydraulic film. There is in effect a counteracting force in this pressurized film that offsets the centrifugal force at the bushing and keeps the rotor centered. In addition, the space of approximately 1/32 inch along the remainder of the rotor forms an oil film at about 35–40 lbs/in$^2$ to provide support bearing assist, and at least partially unload, the dual roller bearings at the first end.

The cost of the vibrator head is minimized since the dual roller bearings at the second end are eliminated, along with the central stub shaft upon which these bearings are usually held. Also, since substantially the entire length of the rotor of the vibrator is eccentric, enhanced vibratory action is gained for a given size of vibrator head.

Preferably, the bushing forming the high pressure film for supporting the second end of the rotor is brass, although other disparate materials, including other metals or plastics can be used. Any equivalent material that has a molecular structure sufficiently different from the steel of the outer casing to prevent galling, especially during the time the rotor is getting up to operating speed or slowing down, can be selected. Of course, the casing itself can be fabricated of other materials, even rigid, high strength, high density polyethylene or the like, if desired.

In accordance with this first embodiment, the bushing preferably extends only along the arc of the curved segment of the second end formed by the rotor. Of importance, the bushing and rotor both include a leading bevel edge to assist in capturing the lubricant and forming the thin film as the rotor rotates.

Furthermore, the bushing includes an axially extending guide edge that mates with a shoulder on the internal surface of the casing. Again, a thin film of oil or other lubricant is formed between the edge and the shoulder to assure proper low friction, guiding relationship. The bushing is brazed or soldered to the rotor along the arc to provide a fixed attachment. Alternatively, high strength adhesive or equivalent attachment means can be used, if desired.

The proximal or first end of the vibrator head is formed by a drive end cap that supports the drive cable having the coupling for connection to the drive shaft of the rotor. At the second end, a distal end cap is provided and forms the peripheral internal surface of the casing for cooperation with the bushing. The guide shoulder is also formed on the internal surface on this end cap. The rotor end with the bushing mating with these surfaces of the end cap is highly stable in both the radial, as well as the axial direction when driven at the desired rotor speed range of approximately 5,000 to 7,000 rpm. The entire length, including the section of the rotor for attachment of the bushing, is eccentric so that the eccentricity is maximized and the resultant vibration during operation is enhanced. The cost is reduced significantly since the usual stub shaft and dual roller bearings at the distal end are eliminated.

In a second embodiment of the invention, single roller bearings replace both the bushing on the second end of the rotor, and the dual roller bearings on the first end. These bearings provide ease of rotation at the relative slow speeds of the rotor as it accelerates up to operating speed and decelerates during stopping. At a spacing of the outer surface of the rotor in the range of 1/64–1/32 inch from the inside of the casing, the oil film that builds up has a hydraulic pressure in the range of 35–80 lbs/in$^2$ that efficiently resists the centrifugal force. This action at least partially unloads the single roller bearings. The bevel on the leading edge of the rotor serves to trap the oil along the full length in order to form the supporting high pressure film.

Still other objects of the present invention will become readily apparent to those skilled in this art from the following description wherein there is shown and described two preferred embodiments of this invention, simply by way of illustration of two of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

Reference will now be made in detail to the present two embodiments of the invention, examples of which are illustrated in the accompanying drawings.

Reference will now be made in detail to the two embodiments selected to illustrate the invention.

DETAILED DESCRIPTION OF THE INVENTION

Figures 1, 2, 3, 3A:
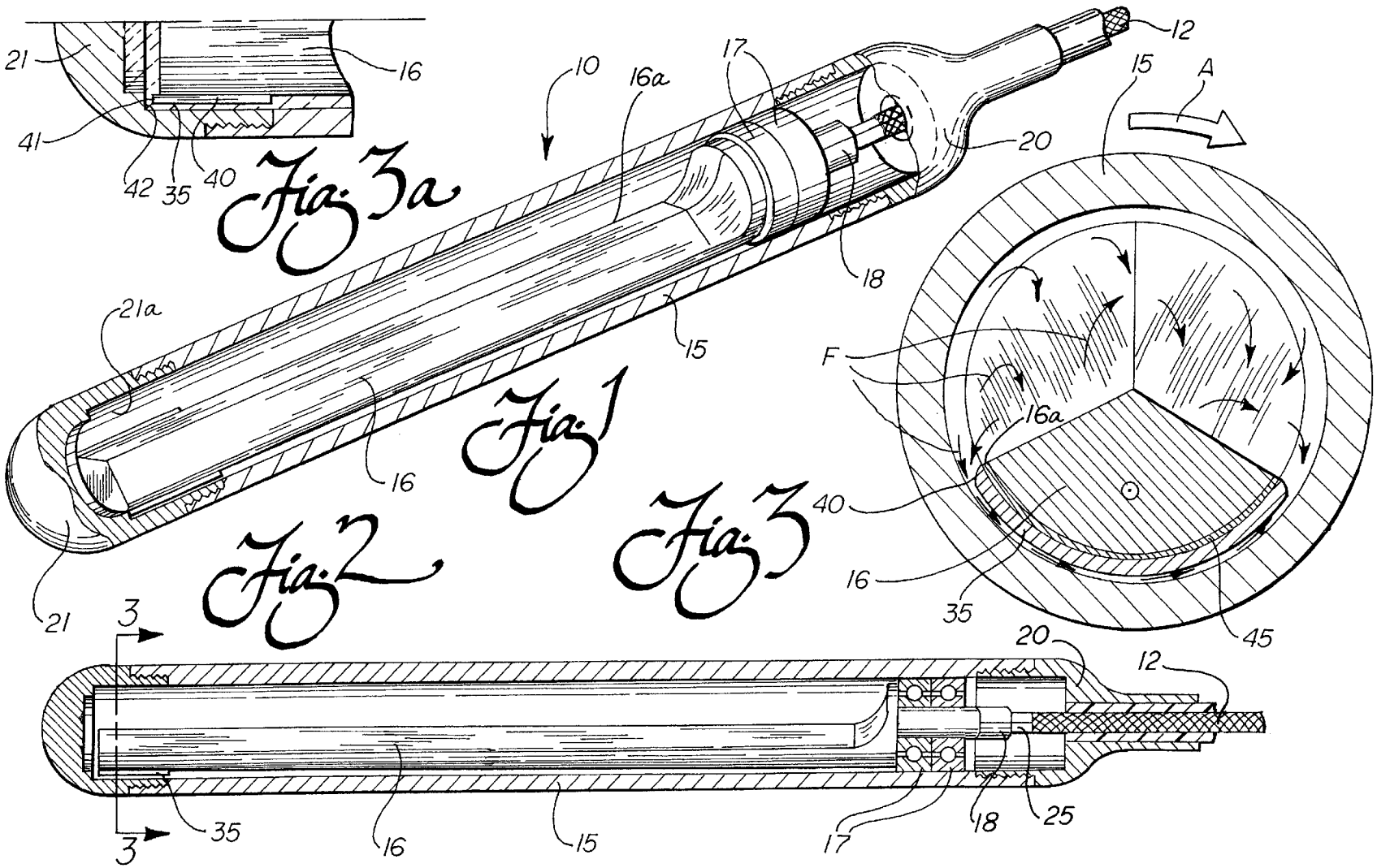
FIG. 1 is an overall perspective view of the first version of a vibrator head for use in a concrete vibrator, and with a portion of the hollow casing broken away for viewing the eccentric rotor and other component parts.
FIG. 2 is a longitudinal cross sectional view of the vibrator head of the present invention and illustrating the extension of the eccentric rotor along the full length of the casing.
FIG. 3 is a cross sectional view taken along line 3—3 of FIG. 2 showing the action of the eccentric rotor rotating within the casing and the manner in which the lubricant is trapped under the bushing on the curved segment to form the high pressure thin film bearing as the rotor rotates.
FIG. 3*a* is a partial, longitudinal cross sectional view, enlarged for greater detail, illustrating the distal end of the rotor, the trapped lubricant supporting the rotor at the second end along the bushing, as well as along the remainder of the curved segment of the rotor, a side view of the beveled edge of the bushing and its axial guide edge.

With reference specifically to FIG. 1 of the drawings, the first embodiment of the improved vibrator head 10 of the present invention is shown in detail, and which is operative to enhance the vibratory action for maximum concrete settling action. At the same time, this design is capable of significantly reducing the initial cost and maintenance requirements.

As also illustrated in FIG. 2, a hollow casing 15 encloses an eccentric rotor 16 mounted by dual roller bearings 17 at a first or proximal end thereof. A pintle/drive shaft 18 extends through the dual bearings 17 adjacent this first end. In accordance with one feature of this embodiment of the invention, the eccentric rotor 16 is not mounted in roller bearings at the distal end, that is adjacent the tip of the casing 15, as has been the standard practice in the prior art. Thus, the eccentric rotor 16 extends all the way along substantially the full length providing additional eccentric mass for enhancing the vibratory effect upon rotation.

The pintle/drive shaft 18 is mounted adjacent a drive end cap 20 at the first end. A distal end cap 21 is provided at the second end. The shaft 18 is connected to the flexible drive cable 12 by a coupling 25. Of course, the flexible sheath/cable is standard and allows the operator to maneuver the head 10 into position for vibrating the body of wet concrete, as illustrated in my '801 application.

As illustrated in FIG. 3, a bearing in the form of an arcuate bushing 35 is permanently attached to the outer surface of the curved segment of the rotor 16. As it is rotated, for example in a clockwise direction, as represented by the action arrow A, lubricant inside the casing 15 is driven with a quasi pumping action and squeezed through the narrow space formed between bushing 35 and the internal surface of the cap 21. The lubricant action is illustrated by the flow arrows F within the hollow interior of the cap 21. The narrow space captures the lubricant so that there is always a protective thin film reducing the friction between the bushing 35 and the internal surface of the casing 15.

An additional feature of this feature of the invention is the provision of a leading beveled edge 40 on the bushing 35 that has been discovered to assist in channeling the lubricant into this narrow space. For the most efficient bearing action, the space is approximately 1/64 inch generating approximately 70–80 lbs/in$^2$ pressure. The simplicity of the rotor 16 with its relatively free, distal end, without sacrificing its radial stability, is a significant advantage to this embodiment. The dual roller bearings that are typically used at the distal end and the center stub shaft are eliminated in this embodiment, thereby opening the additional space for extending the length of the eccentric rotor 16. This structural change, in turn provides additional vibratory action. Especially since the enhancement of the vibration occurs at the tip of the head 10, the efficiency of settling the aggregate and eliminating voids in the concrete is increased even further.

The bushing 35 ig selected to be brass and the casing 15 is hardened steel in the preferred embodiment illustrated. The molecular structure of brass is known for its non-affinity for steel, thus providing the desirable combination of materials in this particular environment. Of course, equivalent disparate materials may be selected as desired.

In addition to the bevel edge to assist in capturing the lubricant, the bushing 35 includes an axial guide edge 41 protruding from the distal end of the rotor 16 and a mating annular shoulder 42 on the internal surface of the cap 21 of the casing 15. A thin film of lubricant is also positioned between these surfaces that provide axial stability as the rotor 16 is free to rotate.

While alternative methods can be used for attaching the bushing 35 to the eccentric rotor 16, a layer of brazing or solder material 45 is preferred (see FIG. 3). Where brass is used as the bushing 35, the use of a layer of brazing or solder metals, such as copper, silver and aluminum alloys have been found to work well.

In this first embodiment, only interior surface of the distal end cap 21 of the casing 15 is engaged by the bushing 35 (see FIGS. 1 and 3*a*). In this manner in the unlikely event that wear occurs, such as due to contaminates being inadvertently introduced into the casing 15, the worn surface can be replaced simply by replacing the cap 21. Similarly, if the bushing 35 becomes worn, it can be removed by heating and a new bushing applied to thereby extend the life of the vibrator head 10 even farther.

In addition to the high pressure oil bearing trapped under the bushing 35 to form a bearing, there is also a bearing formed under the rotor 16. A leading bevel edge 16*a* traps the oil and forces it under the curved segment of the rotor 16 along its entire remaining length. At a spacing of approximately 1/32 inch, the pressure is gauged at approximately 35–40 lbs/in$^2$. This provides an assist to resist the centrifugal forces as the rotor 16 rotates at about 7,000–8,000 RPM. This counterbalancing force is particularly effective in unloading the dual bearing 17.

Figures 4, 5, 6:
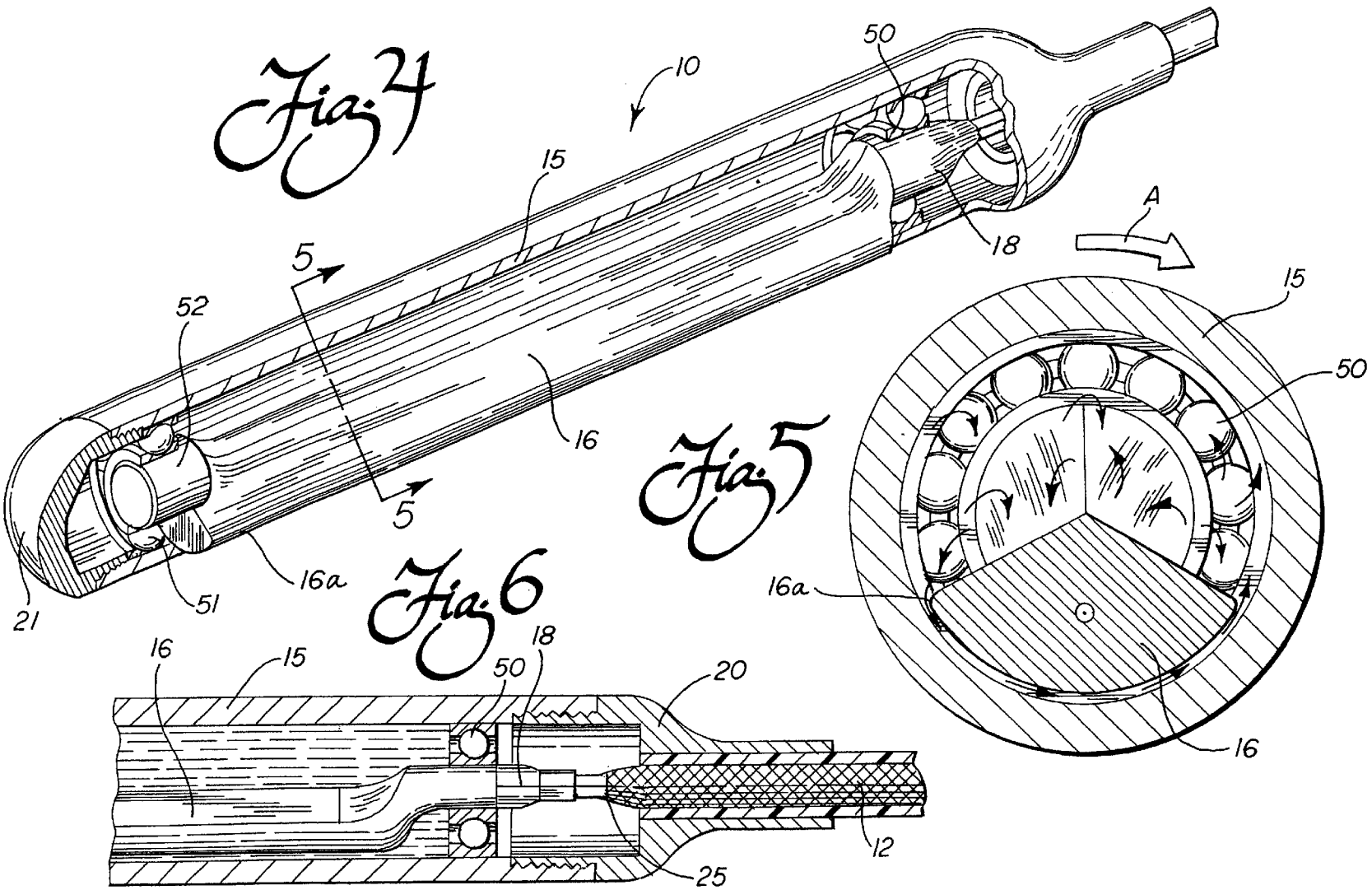
FIG. 4 is a perspective view of a second embodiment of the invention in which the rotor is supported by a single roller bearing at each end and the hydraulic bearing along rotor.
FIG. 5 is an enlarged, cross sectional view taken along line 5—5 of FIG. 4 illustrating the eccentric rotor action to trap the lubricant and provide the counterbalancing force.
FIG. 6 is an enlarged cutaway and partial longitudinal cross-sectional view of the vibrator of FIG. 4 illustrating the manner in this plane how the high pressure lubricant film is counterbalancing the centrifugal force.

The second embodiment of FIGS. 4–6 is similar and employs the same reference numerals for components that are the same. Instead of the dual bearings 17, a single bearing 50 supports the proximate end of the rotor 16 and the bushing 35 is replaced by a single distal end roller bearing 51 on pintle shaft 52. The leading bevel edge 16*a* of the rotor 16 traps the oil (10 W/20 W or equivalent), and a pressure in the range of 35–80 lbs/in$^2$ at a spacing of approximately 1/32–1/64 inch is built up. This action forms the lifting force along the full length of the rotor. This counterbalancing force at least partially unloads the bearings 50, 51. The rotor 16 thus operates on a combination of bearings at both ends and on the hydraulic bearing in between. This unique support is carried out in a very efficient manner over the full range of speeds up to and including the operating speed of 7,000–8,000 RPM.

In view of the foregoing it can be seen that substantial results and advantages are obtained in one embodiment by providing a bushing 40 as the bearing adjacent the second end of the rotor 16 of the vibrator head 10 of the present invention. The arcuate bushing 35 is of a disparate material with respect to the hollow casing 15, and thus has highly effective wear properties. In addition, a thin film of lubricant is held captive in the casing 15 under the bushing 35 and along the rotor 16 length so that a highly efficient and effective bearing system is formed. Also, the axial guide edge 41 also acting through a thin film and the shoulder 42 provides for axial stability of the eccentric rotor 16. Advantageously, since the length of the eccentric rotor 16 is extended at this distal end, the vibratory effect is enhanced with respect to what has been possible in the past. The leading bevel edge 40 of the bushing 35 and the bevel edge 16*a* of the rotor 16 serves to assist in capturing the lubricant and forming the supporting high pressure oil film as the rotor 16 rotates. In the second embodiment, the single end bearings 50, 51 and the hydraulic bearing generated only by the trapped oil under the rotor 16 in between, provides the support. In either case, the rotor 16 rotates efficiently, and is otherwise characterized by radial stability and smooth vibratory action during operation.

The foregoing description of the preferred embodiments of the invention has been presented for purposes of illustration and description. They are not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A head for a concrete vibrator comprising:

a hollow cylindrical casing;

an eccentric rotor disposed in said casing;

a bearing for mounting said rotor for rotation in said casing adjacent a first end;

a second bearing adjacent a second end of said rotor; and a lubricant in said casing forming a thin high pressure film between at least said rotor and the internal surface of said casing sufficient to provide a lifting force for said rotor away from said internal surface and providing a counterbalancing force for said bearings;

said second bearing including a bushing of disparate material spaced from said casing to form a gap and said lubricant forms a high pressure film under said bushing in said gap;

said bushing is arcuate and extends to the second end of said rotor and is positioned in close proximity to said internal surface to form a gap with the thin film of lubricant between said bushing and said surface;

said bushing and said rotor include a leading beveled edge to assist in capturing said lubricant and forming said thin film as the rotor rotates, whereby the eccentricity of said rotor is maintained, while providing smooth rotation and enhanced vibration of the rotor.

2. The vibrator head of claim 1, wherein the spacing between said rotor and said internal surface is approximately 1/32 inch and the pressure in said film is gauged at approximately 35–40 lbs/in$^2$.

3. The vibrator head of claim 1, wherein the spacing between said bushing and said internal surface is approximately 1/64 inch and the pressure in said film is in the range of 70–80 lbs/in$^2$.

4. A head for a concrete vibrator comprising:

a hollow cylindrical casing;

an eccentric rotor disposed in said casing;

a bearing for mounting said rotor for rotation in said casing adjacent a first end;

a second bearing adjacent a second end of said rotor; and a lubricant in said casing forming a thin high pressure film between at least said rotor and the internal surface of said casing sufficient to provide a lifting force for said rotor away from said internal surface and providing a counterbalancing force for said bearings;

said second bearing including a bushing of disparate material spaced from said casing to form a gap and said lubricant forms a high pressure film under said bushing in said gap;

said bushing is arcuate and extends to the second end of said rotor and is positioned in close proximity to said internal surface to form a gap with the thin film of lubricant between said bushing and said surface;

said bushing including an axial guide edge protruding from said second end and a mating shoulder on said internal surface with a second gap having a thin film of lubricant formed between said guide edge and said shoulder, whereby the eccentricity of said rotor is maintained, while providing smooth rotation and enhanced vibration of the rotor.

5. The vibrator head of claim 4, wherein said casing includes an end cap adjacent said second end and forming said internal surface of said casing cooperating with said bushing.

6. The vibrator head of claim 5, wherein said shoulder is formed around said internal surface of said end cap.

7. A head for a concrete vibrator comprising:

a hollow cylindrical casing;

an eccentric rotor disposed in said casing;

a bearing for mounting said rotor for rotation in said casing adjacent a first end;

a second bearing adjacent a second end of said rotor; and a lubricant in said casing forming a thin high pressure film between at least said rotor and the internal surface of said casing sufficient to provide a lifting force for said rotor away from said internal surface and providing a counterbalancing force for said bearings;

said second bearing including a bushing of disparate material spaced from said casing to form a gap and said lubricant forms a high pressure film under said bushing in said gap;

said bushing is arcuate and extends to the second end of said rotor and is positioned in close proximity to said internal surface to form a gap with the thin film of lubricant between said bushing and said surface;

a brazed or soldered layer is formed between said bushing and said rotor along its arc for fixed attachment, whereby the eccentricity of said rotor is maintained, while providing smooth rotation and enhanced vibration of the rotor.

* * * * *